US011945070B2

(12) United States Patent
Zhou et al.

(10) Patent No.: US 11,945,070 B2
(45) Date of Patent: Apr. 2, 2024

(54) ROCKER POLISHING APPARATUS AND METHOD FOR FULL-APERTURE DETERMINISTIC POLISHING OF A PLANAR PART

(71) Applicant: DALIAN UNIVERSITY OF TECHNOLOGY, Liaoning (CN)

(72) Inventors: Ping Zhou, Liaoning (CN); Zhichao Geng, Liaoning (CN); Ying Yan, Liaoning (CN); Lin Wang, Liaoning (CN); Kai Wang, Liaoning (CN); Dongming Guo, Liaoning (CN)

(73) Assignee: DALIAN UNIVERSITY OF TECHNOLOGY, Liaoning (CN)

( * ) Notice: Subject to any disclaimer, the term of this patent is extended or adjusted under 35 U.S.C. 154(b) by 498 days.

(21) Appl. No.: 17/289,718

(22) PCT Filed: Apr. 17, 2020

(86) PCT No.: PCT/CN2020/085342
§ 371 (c)(1),
(2) Date: Apr. 28, 2021

(87) PCT Pub. No.: WO2021/184480
PCT Pub. Date: Sep. 23, 2021

(65) Prior Publication Data

US 2022/0305604 A1 Sep. 29, 2022

(30) Foreign Application Priority Data

Mar. 20, 2020 (CN) ..... 202010202480.5

(51) Int. Cl.
*B24B 1/00* (2006.01)
*B24B 29/02* (2006.01)
(Continued)

(52) U.S. Cl.
CPC ..... *B24B 1/00* (2013.01); *B24B 29/02* (2013.01); *B24B 41/04* (2013.01); *B24B 49/12* (2013.01); *B24B 55/06* (2013.01)

(58) Field of Classification Search
CPC ..... B24B 37/00; B24B 37/005; B24B 37/04; B24B 37/042; B24B 37/07; B24B 37/10;
(Continued)

(56) References Cited

U.S. PATENT DOCUMENTS 6,093,088 A * 7/2000 Mitsuhashi ..... B24B 37/102 451/287
2009/0318060 A1 12/2009 Dhandapani et al.
2015/0314416 A1* 11/2015 Shinozaki ..... B24B 49/02 451/5

FOREIGN PATENT DOCUMENTS

CN 104191370 A 12/2014
CN 104209863 A 12/2014
(Continued)

OTHER PUBLICATIONS

Chupeng Zhang et al., "Design of an ultra-precision CNC chemical mechanical polishing machine and its implementation", Optifab 2017, vol. 10448, Oct. 16, 2017.
(Continued)

*Primary Examiner* — Joel D Crandall
*Assistant Examiner* — Alberto Saenz
(74) *Attorney, Agent, or Firm* — NKL Law; Allen Xue

(57) ABSTRACT

A rocker polishing apparatus for full-aperture deterministic polishing of a planar part includes a control system, a substrate, a lifting plate, a polishing module and a measuring module. The polishing module and the measuring module are arranged on the substrate. The lifting plate is arranged between the polishing module and the measuring module. The polishing module includes a rocker mechanism, a polishing pad surface dressing mechanism, a polishing pad
(Continued)

surface profile measuring apparatus and a continuous polishing pad mechanism. The apparatus allows the material removal rate distribution of the planar part and the surface profile of the planar part be in the normalized mirror symmetry relationship by controlling the material removal rate distribution on the surface of the planar part, thereby implementing the deterministic polishing of the planar part and ensuring the efficient convergence of the surface profile of the planar part in the polishing process.

3 Claims, 6 Drawing Sheets

(51) Int. Cl.
*B24B 41/04* (2006.01)
*B24B 49/12* (2006.01)
*B24B 55/06* (2006.01)

(58) Field of Classification Search
CPC ..... B24B 37/102; B24B 37/27; B24B 37/30; B24B 37/34; B24B 37/345; B24B 53/005; B24B 53/12; B24B 53/02; B24B 53/017; B24B 41/067; B24B 41/04; B24B 7/228; B24B 7/04; B24B 1/00; B24B 29/02; B24B 49/04; B24B 55/06
USPC ..... 451/9
See application file for complete search history.

(56) References Cited

FOREIGN PATENT DOCUMENTS

| | | | |
|---|---|---|---|
| CN | 106736612 | A | 5/2017 |
| CN | 108381331 | A | 8/2018 |
| CN | 110394728 | A | 11/2019 |
| JP | 2006093296 | A | 4/2006 |
| JP | 2019063964 | A | 4/2019 |

OTHER PUBLICATIONS

Ruiqing Xie et al., "The Effect of Characteristic of Pad on Surface Form of Optical Flats in Polishing", Opto-Electronic Engineering, vol. 37, No. 7, Jul. 2010.

* cited by examiner

ROCKER POLISHING APPARATUS AND METHOD FOR FULL-APERTURE DETERMINISTIC POLISHING OF A PLANAR PART

FIELD OF THE INVENTION

The present invention relates to the technical field of polishing, and more particularly, to a rocker type polishing apparatus and method applied to full-aperture deterministic polishing of a planar part.

BACKGROUND

Optical systems are widely applied in aspects of aerospace, national defense and military, space exploration, astronomical optical observation and so on. In the field of engineering optics such as ultraviolet optics, highlight optics, short wave optics and far-infrared wave optics, planar parts are typically used as such imaging elements as transmission elements, reflection elements and diffraction elements or other functional elements. With the continuous development and application of optical technologies, there are increasing improved requirements on technological levels in manufacture of the optical elements. On the one hand, the requirements on the precision of the optical elements are increasing; and on the other hand, with the increased demand for the optical systems, the number of optical elements required is increased day by day and to improve the machining efficiency of the optical elements has become one of the urgent requirements for the development of the optical technologies.

In order to machine the optical element at a high precision and high surface quality, the conventional machining of the planar optical element includes processes of grinding, lapping, polyurethane polishing, pitch polishing, and figuring and so on. The polyurethane polishing can effectively remove the grinding damaged layers, but has the obvious edge effect and is prone to the edge collapse phenomenon during polishing. The nonuniform wear of the polyurethane polishing pad also easily leads to the middle-convex surface profile and is hard to obtain a high precision of the surface profile. Pitch lap continuous polishing is the most popular full-aperture high-precision planar machining method at present and may obtain the high precision of the surface profile. However, the pitch lap continuous polishing has a low material removal rate; and the dressing on the surface profile of the pitch lap highly depends on the experience of workers, which has a high uncertainty and results in a low machining efficiency, and it is difficult to achieve stable and efficient machining of the optical elements on a large scale. In view of this, there is a need for a full-aperture deterministic polishing apparatus and method. With accurate analysis on the material removal rate and accurate control on the surface profile of the polishing pad, the surface profile of the planar part is fast converged, thereby implementing the stable and efficient machining of the optical elements on the large scale.

Presently, some researches on the full-aperture polishing method and apparatus have been conducted by many scholars. In the field of machining methods, the pad can be dressed to flat such that pressure nonuniformity is generated at concave and convex positions on the surface of the planar part, thereby generating a differentiated material removal rate; and the surface profile of the pad is gradually coped to the surface profile of the planar part to implement the high-precision planarization (Zhang, C., Zhao, H., Gu, Y., Ban, X., & Jiang, C, 2017, Design of an ultra-precision CNC chemical mechanical polishing machine and its implementation, Optifab 2017, 104482Q.). The inclination angle of the dressing shaft may also be adjusted to dress the surface profile of the polishing pad as a shape approximately reverse to the surface profile of the planar part, and the higher polishing efficiency is achieved by increasing a difference between contact pressures at concave and convex positions of the planar part (Xie Ruiqing, Li Yaguo, Wang Jian, Chen Xianhua, Huang Hao, & Xu Qiao, 2010, Analysis on Influences of Features of Polishing Pad on Surface Profile of Workpiece During Optical Machining, Optics Engineering, 37.). In a patent entitled "A Global Correction Process Apparatus and Method for Planar Part" (CN 108381331 A), the polishing pad is dressed as the patterned polishing pad having the special groove according to the surface profile of the planar part, and the material removal rate distribution on the surface of the planar part is controlled such that the material removal rate distribution and the surface profile of the planar part are in a normalized mirror symmetry relationship, thereby implementing the deterministic machining of the planar part.

In order to implement the high-precision planar machining of the planar part and guarantee the planeness of the pad and copy the planeness to the planar part which need to be machined, the polishing pad needs to be dressed before polishing processing. In a patent entitled "Precision Lead Screw Driven Annular Gas Hydrostatic Guideway" (CN 106736612 A), through the precision lead screw driven annular gas hydrostatic guide rail, it is ensured that the gas hydrostatic guide rail has a smaller gas film clearance, a higher stiffness and a higher precision. However, the high-precision hydrostatic guide rail provided on the apparatus has a higher cost.

In order to deterministically machine the planar part, i.e., deterministically control the material removal rate distribution on the surface of the planar part, a grooving apparatus can be used to provide a groove on the polishing pad. In the patent entitled "A Global Correction Process Apparatus and Method for Planar Part" (CN 108381331 A), by adding the polishing pad surface turning unit and the groove cutting unit on the conventional lapping machine or polisher, the polishing pad with the low peak-to-valley (PV) value and the groove structure is machined. However, before each time of polishing process, the polishing pad needs to be grooved again to cause a serious loss of the polishing pad.

In order to implement surface dressing of the polishing pad and guarantee the stable material removal rate in the polishing process, in a patent entitled "Polishing Pad Dresser and Manufacturing Method Thereof, Polishing Pad Dressing Apparatus and Polishing System" (CN 104209863 A), the surface roughness of the surface of the dresser is increased, and the polyhedral lapping particles with regular shapes are selected. In a patent entitled "Closed-loop Control for Effective Pad Conditioning" (US 20090318060 A1), the force of the dresser on the polishing pad is automatically adjusted by closed-loop control. However, the above polishing pad dressing apparatus has a single function that only removes a glazing layer generated in polishing processing.

To sum up, the present researches on the full-aperture polishing methods and apparatuses still have the following problems:

(1) The specific surface profile of the planar part is not fully considered but only the pad is leveled, which results in that the convergence rate of the surface profile of the planar part in the polishing process is slow.

(2) The device for leveling the polishing pad uses the hydrostatic apparatus, causing a high device cost.

(3) By means of cutting the groove on the polishing pad for the full-aperture deterministic polishing, the utilization rate on the polishing pad is low, causing a high machining cost.

(4) The dressing on the polishing pad in some apparatuses only implements the removal of the glazing layer, and cannot control the overall surface profile of the polishing pad.

(5) The present polishing device fails to implement the machining-measuring integrated design, causing an inadequate capability on batch manufacture of the planar part automatically.

SUMMARY OF THE INVENTION

In order to solve the above problems in the prior art, the present invention designs a rocker type polishing apparatus and method for full-aperture deterministic polishing of a planar part which can implement the quick convergence rate on the surface profile of the planar part, low device cost, high machining efficiency, deterministic dressing on the surface profile of the polishing pad and high automation level.

To achieve the above objective, a substrate is added on the basis of the conventional continuous polisher, a rocker mechanism is mounted on the substrate via the upright post, a diamond dresser with constant pressure is mounted at a side of the rocker of the rocker mechanism, and a linear guide rail carrying a laser displacement sensor is mounted on the other side of the rocker. The rocker is adjusted to the position where the measuring head of the laser displacement sensor moves radially along the polishing pad, and the original surface profile of the polishing pad is collected by moving the laser displacement sensor along the linear guide rail. The polishing pad surface dressing mechanism is used, according to the measurement data on the surface profile of the polishing pad, to dress the polishing pad by adjusting dressing time at each position, and then the planar part was polished by that polishing pad. Obtaining the material removal rate distribution through a difference between surface profiles before and after polishing the planar part, and according to the surface profile of each of the planar part and the leveled polishing pad as well as the removal rate distribution of the planar part when polished with the leveled polishing pad, an ideal surface profile of the polishing pad that can make the surface profile of the planar part converged fast and dressing parameters thereof are determined by using a polishing pad surface profile design method. The surface profile of the polishing pad is dressed as the calculated ideal surface profile of the polishing pad by using the polishing pad surface dressing mechanism, and the planar part is polished with the dressed polishing pad. The mechanical arm feeds the polished planar part to the planar part surface profile automatic measuring apparatus for washing and drying, the surface profile is then measured at the measuring station so as to determine whether the polishing result meets a requirement; and if no, the above entire process is repeated till the high-precision planar part meeting the requirement is obtained.

The technical solutions of the present invention are as follows:

A rocker type polishing apparatus for full-aperture deterministic polishing of a planar part includes a control system, a substrate, a lifting plate, a polishing module and a measuring module.

The control system is configured to control a pose of a mechanical arm, a swing of a rocker, a movement of a guide rail slider, start of a laser displacement sensor, a rise and fall of the lifting plate, start of a motor connected to a diamond dresser and operation of a continuous polisher, and a control panel of the control system is located at a side of the whole apparatus.

Both the polishing module and the measuring module are located on the substrate; and the lifting plate is located between the polishing module and the measuring module.

The polishing module includes a rocker mechanism, a polishing pad surface dressing mechanism, a polishing pad surface profile measuring apparatus and a continuous polishing pad mechanism.

The rocker mechanism includes a stepping motor, an upright post and the rocker, the upright post is mounted on the substrate. One end of the rocker is hinged to the upright post, and the other end of the rocker is suspended above the continuous polishing pad mechanism.

The polishing pad surface dressing mechanism includes a cylindrical shaft, a linear bearing, the motor and the diamond dresser. The cylindrical shaft is fixed on a rear side of the rocker. The motor is mounted on the cylindrical shaft through the linear bearing. The diamond dresser is mounted on a rotating shaft of the motor and located above a polishing pad.

The polishing pad surface profile measuring apparatus includes a linear guide rail and the laser displacement sensor. The linear guide rail is fixed on a front side of the rocker. The laser displacement sensor is slidably connected to the linear guide rail through a slider, and is fixed below the slider.

The continuous polishing pad mechanism includes the polishing pad, a fixing bolt, a driven wheel, a shift fork, a driving wheel motor, a fixing frame, a driving wheel and a turntable. The turntable is mounted on a spindle of the continuous polisher by the fixing bolt. The polishing pad is adhered on the turntable. The fixing frame is mounted on the substrate by a bolt. The driving wheel motor is mounted on a sidewall of the fixing frame. The shift fork is mounted on the sidewall of the fixing frame and located below the driving wheel motor. The driven wheel and the driving wheel are respectively mounted on two ends of the shift fork and suspended above the polishing pad.

The measuring module includes a planar part surface profile automatic measuring apparatus and a mechanical arm. The planar part surface profile automatic measuring apparatus includes a washing station, a drying station and a measuring station.

The washing station, the drying station and the measuring station are sequentially mounted on the substrate. A base of the mechanical arm is fixed on a sidewall of the whole apparatus and located above the drying station.

The stepping motor controls, by means of the control system, an angle and a speed that the rocker rotates along the upright post.

The polishing pad surface profile measuring apparatus is driven by the rocker to a position where a measurement locus of the laser displacement sensor passes through a centre of the polishing pad, and a pose of the laser displacement sensor and a height towards the polishing pad are adjusted to meet the requirements for measuring data, and the laser displacement sensor is controlled to move along the linear guide rail, i.e., move along a radial direction of the polishing pad, such that a radial surface profile of the polishing pad is obtained.

The polishing pad surface dressing mechanism is connected to the rocker by the linear bearing. In a process of dressing the polishing pad, the diamond dresser is contacted with a surface of the polishing pad at a constant pressure by self-weight and a weight of the motor, and dressing times of the diamond dresser at different radial positions of the polishing pad is controlled by controlling a swing speed of the rocker, thereby implementing deterministic dressing of the polishing pad.

Further, the washing station includes a deionized water spraying device and a sewage storage container. The drying station includes a rack having a planar part clamping device, and a strong blower. The measuring station includes a planeness measurer.

The present disclosure also provides a rocker type polishing method for full-aperture deterministic polishing of a planar part using a rocker type polishing apparatus for the full-aperture deterministic polishing of the planar part, including the following steps:

Step A. measuring an original surface profile of each of a polishing pad and a planar part Adjusting the rocker to a position where a measuring head of the laser displacement sensor moves radially along the polishing pad, collecting the original surface profile of the polishing pad by moving the laser displacement sensor along the linear guide rail, and feeding the planar part to the measuring station with the mechanical arm to obtain the original surface profile of the planar part.

Step B. obtaining a material removal rate distribution of the planar part when a leveled polishing pad is used Starting the guide rail and the laser displacement sensor such that a slider of the guide rail drives the laser displacement sensor to move radially along the polishing pad, thereby measuring the original surface profile of the polishing pad. Starting the rocker and the motor connected to the diamond dresser such that the diamond dresser dresses the polishing pad radially at a constant speed along the radial direction of the polishing pad, thereby remeasuring a surface profile of the polishing pad. According to the difference between the surface profiles before and after dressing polishing pad and the dressing time, obtaining a dressing removal rate distribution of the polishing pad as follows:

$$MRR_{pi} = \frac{u_{pi}^{0} - u_{pi}^{1}}{t_p} n,\ i = 1, 2, 3 \ldots n \tag{1}$$

wherein, the $MRR_{pi}$ represents a dressing removal rate of the polishing pad at the $i^{th}$ discrete point, the $u_{pi}^{0}$ represents an original surface profile of the polishing pad at the $i^{th}$ discrete point, the $u_{pi}$ represents a dressed surface profile of the polishing pad at the $i^{th}$ discrete point, the $t_p$ represents how long the polishing pad has been dressed, and the n represents the number of radial discrete points of the polishing pad, the surface profile is the height data of all discrete points on the surface of the polishing pad.

Differencing the original surface profile of the polishing pad with a horizontal plane to determine a removal amount distribution of the surface of the polishing pad. Keeping a dressing constant pressure in a dressing process, the dressing removal rate distribution of the polishing pad being known, and determining the dressing time of the diamond dresser at each radial position of the polishing pad, polishing the planar part on the leveled polishing pad after dressing, and obtaining the material removal rate distribution $MRR_c$ (r,θ) of the planar part through a difference between the surface profiles before and after polishing the planar part:

$$MRR_c(r, \theta) = \frac{u_c(r, \theta) - u_c'(r, \theta)}{t_c} \tag{2}$$

wherein, the $MRR_c$ (r,θ) represents the material removal rate distribution of the planar part, the $u_c$ (r,θ) represents a surface profile of the planar part before polishing, the $u_c^1$ (r,θ) represents a surface profile of the planar part after polishing, the r represents a distance from a point on the planar part to a center of the planar part, the θ represents an angle of a point on the planar part in a coordinate system with the center of the planar part as an origin, and the $t_c$ represents polishing time.

Step C. determining an ideal surface profile of the polishing pad that makes the surface profile of the planar part converged fast and dressing parameters thereof Determining, according to the surface profile of each of the planar part and the leveled polishing pad as well as the removal rate distribution of the planar part when it is polished by the leveled polishing pad, by using a polishing pad surface profile design method, the ideal surface profile of the polishing pad that makes the surface profile of the planar part converged fast and the dressing parameters thereof, including the following steps:

Step C1. obtaining a Preston coefficient K(r,θ): the material removal rate distribution of the planar part meeting a Preston equation:

$$MRR_c(r,\theta)=K(r,\theta)P(r,\theta)V(r,\theta) \tag{3}$$

wherein, the K(r,θ) represents the Preston coefficient, the P(r,θ) represents a contact pressure during polishing processing, and the V(r,θ) represents a rotational velocity of the planar part relative to the polishing pad;

Converting the Preston equation (3) into equation (4) in order to obtain the Preston's coefficient K(r,θ):

$$K(r, \theta) = \frac{MRR_c(r, \theta)}{P(r, \theta)V(r, \theta)} \tag{4}$$

Calculating the material removal rate distribution $MRR_c$ (r,θ) of the planar part according to equation (2) when using the leveled polishing pad;

Obtaining, according to a rotational velocity parameter used in the polishing process, relative xvelocity V(r,θ) of the planar part and the polishing pad at each position by kinematics analysis as follows:

$$\begin{cases} V(r, \theta) = \sqrt{v_x(r, \theta)^2 + v_z(r, \theta)^2} \\ v_x(r, \theta) = -\omega_c r\sin\theta + \omega_p r\sin\theta \\ v_y(r, \theta) = \omega_c r\cos\theta - \omega_p(e + r\cos\theta) \end{cases} \tag{5}$$

wherein, the $v_x$(r,θ) represents velocity components of relative velocity of the planar part and the polishing pad on an x axis of the planar part, the $v_y$(r,θ) represents velocity components of relative velocity of the planar part and the polishing pad on a y axis of the planar part, the $\omega_p$ represents a revolution velocity of the polishing pad and the $\omega_c$ represents an autorotation velocity of the planar part;

Calculating a contact pressure distribution model as follows based on the Winkler elastic foundation model:

$$P(r,\theta)=\begin{cases}K[\delta-u(r,\theta)], & \delta>u(r,\theta)\\ 0, & \delta\leqslant u(r,\theta)\end{cases} \tag{6}$$

$$K=\frac{(1-v)E}{(1+v)(1-2v)L}$$

$$u(r,\theta)=u_c(r,\theta)-u_p(r,\theta)$$

$$\frac{F}{K}=\sum A[\delta-u(r,\theta)]$$

wherein, the K represents a stiffness coefficient, the 6 represents contact deformation, the $u(r,\theta)$ represents a thickness of an elastic layer, the v represents a Poisson ratio, the E represents an elasticity modulus, the L represents denotes a thickness of the polishing pad, the $u_p(r,\theta)$ represents a circumferentially homogenized surface profile of the polishing pad within a range of the polishing processing, the F represents a positive pressure, i.e., gravity of the planar part and a loading block, and the A represents an area of a region represented by a discrete point of the planar part;

Obtaining, based on the Winkler elastic foundation model, a polishing pressure P(r,θ) of each point by mechanical analysis in a condition where the surface profile of the planar part and the surface profile of the leveled polishing pad are known;

Therefore, the Preston coefficient K(r,θ) of the planar part is obtained according to the equation (4) due to the $MRR_c$ (r,θ), the V (r,θ) and the P(r,θ).

Step C2. obtaining the ideal surface profile of the polishing pad

Based on a hypothesis that the Preston coefficient in the polishing process is unchanged and the Winkler elastic foundation model, performing normalization and mirror symmetry treatment on the surface profile of the planar part obtained in step B, which is taken a normalization and mirror symmetry treatment result as a normalization result of the material removal rate distribution $MRR_c'(r,\theta)$ of the planar part corresponding to an ideal polishing pad, and making an analysis in combination with a model for calculating the material removal rate distribution of the planar part to obtain the ideal surface profile of the polishing pad required by the full-aperture deterministic polishing.

The method for obtaining the ideal surface profile of the polishing pad including:

Performing the normalization and mirror symmetry treatment on the surface profile of the planar part obtained in step B, which is taken as the normalization result of the material removal rate distribution $MRR_c'(r,\theta)$ of the planar part corresponding to the ideal polishing pad, with an equation as follows:

$$\frac{MRR_c'(r,\theta)-\min[MRR_c'(r,\theta)]}{\max[MRR_c'(r,\theta)]}=\frac{-u_c'(r,\theta)-\min[-u_c'(r,\theta)]}{\max[-u_c'(r,\theta)]} \tag{7}$$

$$\frac{MRR_c'(r,\theta)-\min[MRR_c'(r,\theta)]}{\max[MRR_c'(r,\theta)]}=\frac{u_c'(r,\theta)-\max[u_c'(r,\theta)]}{\min[u_c'(r,\theta)]}$$

Based on the hypothesis that the Preston coefficient K(r,θ) in the polishing process is unchanged, in view of an actual condition where the V(r,θ) is unchanged due to the rotational velocity process parameter used in the polishing process is unchanged, making the analysis in combination with the model for calculating the material removal rate distribution of the planar part to obtain a normalization result of an ideal contact pressure distribution P'(r,θ) on the surface of the planar part;

Based on the Winkler elastic foundation model, in a condition where the surface profile of the planar part obtained in step B is known, obtaining a contact pressure corresponding to any surface profile of the polishing pad, taking the normalization result of the ideal contact pressure distribution P'(r,θ) as an optimization goal to obtain the corresponding ideal surface profile of the polishing pad required by the full-aperture deterministic polishing, and obtain the ideal contact pressure distribution P'(r,θ) for the surface of the planar part;

Step C3. determining the dressing parameters of the polishing pad

Determining, as the ideal surface profile of the polishing pad and the surface profile of the leveled polishing pad are respectively measured, keeping the dressing pressure constant in the dressing process, and the dressing removal rate distribution of the polishing pad is known according to step B, the dressing time of the diamond dresser at the radial position of the polishing pad as follows:

$$T_{pi}=\frac{u_{pi}-u_{pi}'}{MMR_{pi}},\ i=1,2,3\ldots n \tag{8}$$

wherein, the $T_{pi}$ represents a dressing time of the diamond dresser at the $i^{th}$ discrete point of the polishing pad, the $u_{pi}$ represents a surface profile of the leveled polishing pad at the $i^{th}$ discrete point, and the $u_{pi}'$ represents an ideal surface profile of the polishing pad at the $i^{th}$ discrete point;

Step C4. predicting the polishing time

Obtaining the material removal rate distribution $MRR_c'$ (r,θ) of the planar part corresponding to the ideal polishing pad as follows:

$$MRR_c'(r,\theta)=\frac{MRR_c(r,\theta)P'(r,\theta)}{P(r,\theta)} \tag{9}$$

deducing an evolution of the surface profile of the planar part in the polishing process in combination with the surface profile of the planar part and the material removal rate distribution $MRR_c'(r,\theta)$ of the planar part corresponding to the ideal polishing pad obtained in step B, and selecting the time point when the peak valley (PV) value of the surface profile of the planar par is minimum as the predicted polishing time;

Step D. dressing the polishing pad

Controlling a polishing pad surface dressing mechanism to dress the surface profile of the polishing pad as the calculated ideal surface profile of the polishing pad;

Step E. polishing the planar part

Polishing the planar part with the parameters same as those when the material removal rate distribution of the planar part is obtained with the leveled polishing pad in step B, the parameters including a rotational velocity of each of the planar part and the polishing pad, a component of a polishing slurry, a supply position of the polishing slurry, a flow velocity of the polishing slurry and a polishing load; and Step F. measuring the surface profile of the planar part feeding, by the mechanical arm, the polished planar part to a washing station, and washing to remove the polishing slurry and rest impurities on the surface of the planar part with deionized water at 20-26° C.; then feeding the planar part to the drying station to clamp, and quickly drying the planar part with a strong blower that outputs room temperature air at 20-26° C.; and after the surface of the planar part is clean, transferring the planar part to the measuring station to measure the surface profile of the planar part, determining whether a polishing result meets a requirement; and if no, performing step A till a surface of a high-precision planar part meeting the requirement is obtained.

Compared with the prior art, the present invention has the following beneficial effects:

1. The present invention fully considers the specific surface profile of the planar part, and makes the material removal rate distribution of the planar part and the surface profile of the planar part be in the normalized mirror symmetry relationship by controlling the material removal rate distribution on the surface of the planar part, thereby implementing the deterministic polishing of the planar part and ensuring the efficient convergence of the surface profile of the planar part in the polishing process.

2. The present invention dresses the surface profile of the polishing pad by controlling the dressing time of the diamond dresser on the polishing pad, using the low-cost operation manner to complete the high-precision polishing process, thereby reducing the device cost.

3. The present invention does not damage the polishing pad in the dressing process, thereby increasing utilization times of the polishing pad, prolonging the service life of the consumable and reducing the cost of the full-aperture deterministic polishing.

4. The polishing pad surface dressing mechanism in the present invention can dress the surface profile of the polishing pad and remove the surface glazing layer at the same time, simplifying the structure of the device and having the low cost.

5. The present invention grabs the planar part using the mechanical arm to ensure the machining-measuring integration, which is of great significance to high-level polishing processing that enhances the automation, implements the batch production, promotes the productivity and improves the finished product rate, and improves the automatic batch manufacturing capability on optical elements.

6. The lifting plate of the present invention is located between the polishing module and the measuring module. During the polishing processing, the lifting plate rises in order to prevent a polishing slurry of the polishing module from affecting the measuring module. During the measuring operation, the lifting plate falls in order to prevent obstruction to the mechanical arm.

Figure 1:
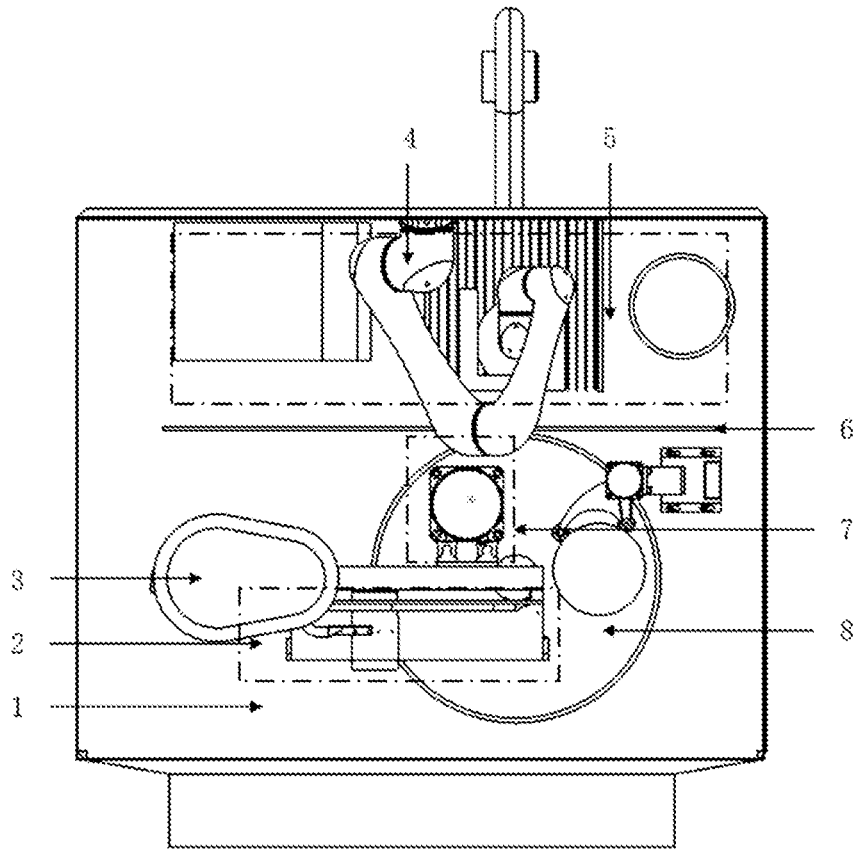
FIG. 1 is a structural schematic diagram of an apparatus of the present invention.

In the figures: 1. substrate, 2. polishing pad surface profile measuring apparatus, 3. rocker mechanism, 4. mechanical arm, 5. planar part surface profile automatic measuring apparatus, 6. lifting plate, 7. polishing pad surface dressing mechanism, 8. continuous polishing pad mechanism, 21. laser displacement sensor, 22. linear guide rail, 31. rocker, 32. upright post, 33. stepping motor, 51. measuring station, 52. drying station, 53. washing station, 71. motor, 72. linear bearing, 73. cylindrical shaft, 74. diamond dresser, 81. polishing pad, 82. fixing bolt, 83. driven wheel, 84. shift fork, 85. driving wheel motor, 86. fixing frame, 87. driving wheel, 88. planar part, and 89. turntable.

BRIEF DESCRIPTION OF THE INVENTION

The present invention is further described below in combination with the accompanying drawings and some implementation methods.

The present invention aims at the machining of the planar part 88. With accurate analysis on the material removal rate and accurate control on the surface profile of the polishing pad, the present invention can make the surface profile of the planar part 88 converged fast, thereby implementing the stable and efficient machining of the planar part 88 on a large scale. According to the present invention, the substrate 1 is added on the basis of the conventional continuous polisher; the rocker mechanism 3 is mounted on the substrate 1 via the upright post 32; the diamond dresser 74 capable of keeping a constant pressure is mounted at a side of the rocker 31 of the rocker mechanism 3, and the linear guide rail 22 carrying the laser displacement sensor 21 is mounted on the other side of the rocker 31. The control system is configured to control a pose of the mechanical arm 4, a swing of the rocker 31, a movement of the guide rail 22, start of the laser displacement sensor 21, a rise and fall of the lifting plate 6, start of the motor connected to the diamond dresser 74 and operation of the continuous polisher, and the industrial control computer and the programmable logic controller (PLC) control technology is adapted by the control system. The rocker 31 is adjusted to the position where the measuring head of the laser displacement sensor 21 moves radially along the polishing pad 81, the original surface profile of the polishing pad 81 is collected by moving the laser displacement sensor 21 along the linear guide rail 22. According to the measurement data on the surface profile of the polishing pad 81, the polishing pad surface dressing mechanism 7 is used to level the polishing pad 81 by adjusting dressing time at each position, and the planar part 88 is polished. Obtaining the material removal rate distribution through a difference between surface profiles before and after polishing the planar part 88, and according to the surface profile of each of the planar part 88 and the leveled polishing pad 81 as well as the removal rate distribution of the planar part 88 when polished with the leveled polishing pad 81, an ideal surface profile of the polishing pad 81 that can make the surface profile of the planar part 88 converged fast and dressing parameters thereof are determined by using a polishing pad surface profile design method. The surface profile of the polishing pad 81 is dressed as the calculated ideal surface profile of the polishing pad 81 by using the polishing pad surface dressing mechanism 7, and the planar part 88 is polished with the polishing pad 81. The polished planar part 88 is fed by the mechanical arm 4 to the planar part surface profile automatic measuring apparatus 5 for washing and drying, the surface profile is then measured at the measuring station 51 and whether a polishing result meets a requirement is determined; and if no, the above entire process is repeated till the high-precision planar part 88 meeting the requirement is obtained.

Figure 2:
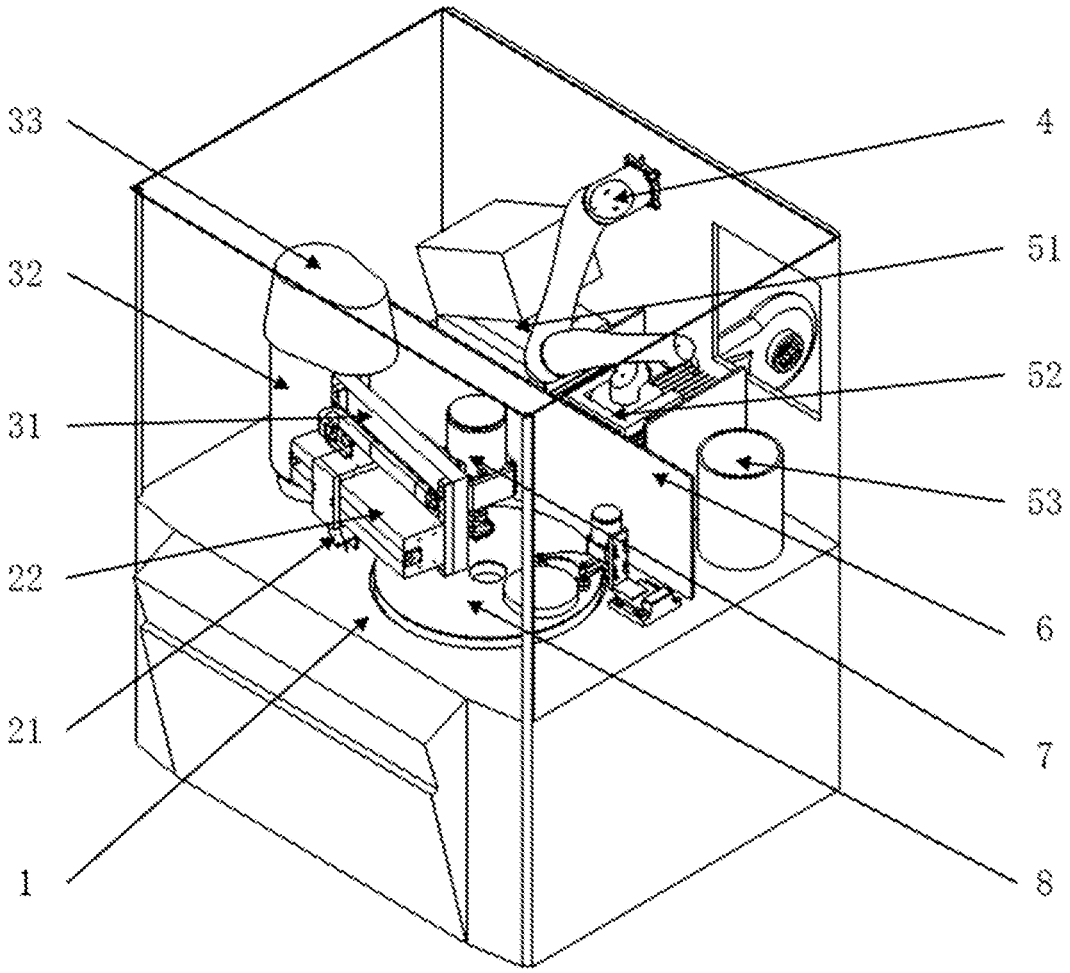
FIG. 2 is an axonometric diagram of FIG. 1.
Figure 3:
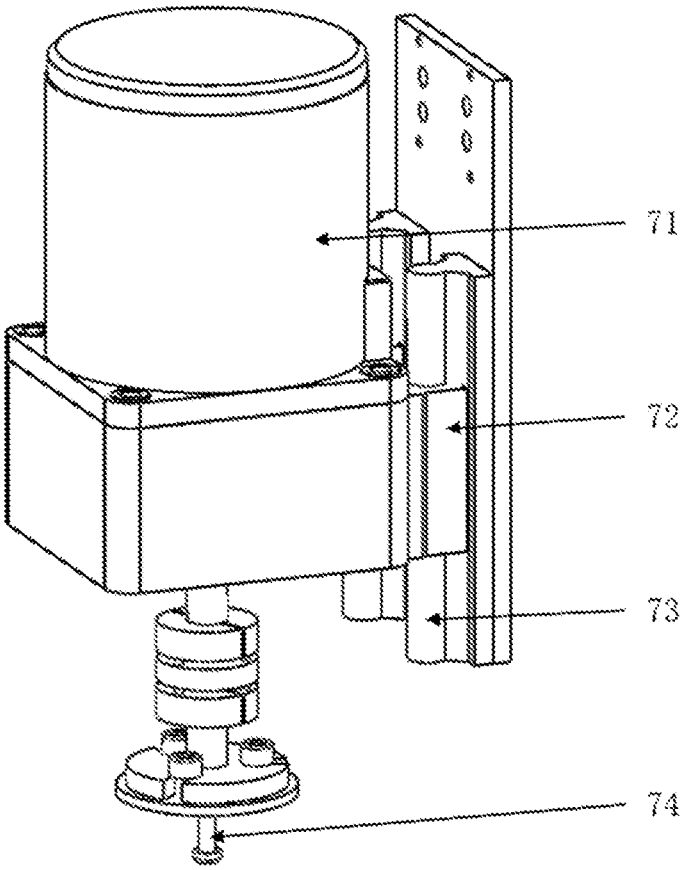
FIG. 3 is a schematic diagram of a polishing pad surface dressing mechanism.
Figure 4:
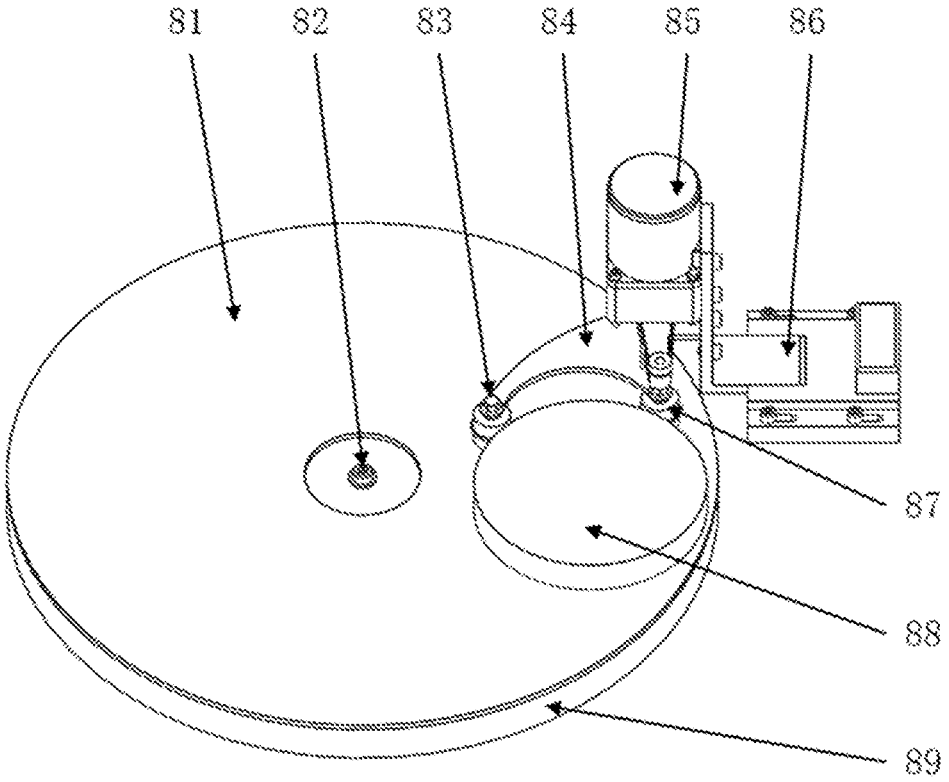
FIG. 4 is a schematic diagram of a continuous polishing pad mechanism.

FIGS. 1-2 are a schematic diagram of a full-aperture deterministic polishing apparatus of the present invention. The apparatus includes a substrate 1, a continuous polishing pad mechanism 8 located at a central position of the substrate 1 (as shown in FIG. 4), an upright post 32 mounted on the substrate 1, a rocker 31 hinged to the upright post 32 and located above the continuous polishing pad mechanism 8, a stepping motor 32 for controlling a swing of the rocker 31, a linear guide rail 22 fixed on a front side of the rocker 31, a laser displacement sensor 21 slidably connected to the linear guide rail 22, a polishing pad surface dressing mechanism 7 fixed on a rear side of the rocker 31 (as shown in FIG. 3), a lifting plate 6 located at an intersection between a polishing module and a measuring module on the substrate 1, a washing station 53, a drying station 52 and a measuring station 51 that are sequentially mounted on the substrate 1 from left to right, and a mechanical arm 4 fixed on a sidewall of the whole apparatus and located above the drying station 52.

When the pad needs to be dressed, the stepping motor 33 and motor 71 located on a top of the upright post 32 are started, the dressing time of the diamond dresser 74 in the polishing pad surface dressing mechanism 7 at each position is adjusted by controlling a swing speed of the rocker 31, and the polishing pad 81 is dressed to an ideal surface profile.

When measuring the surface profile of the polishing pad 81, the polishing pad surface profile measuring apparatus 2 is driven by the rocker 31 to a station that a measurement locus of the laser displacement sensor 21 passes through a centre of the polishing pad 81, and a pose of the laser displacement sensor 21 and a height towards the polishing pad 81 are adjusted to meet the measurement data collection requirement, and the laser displacement sensor 21 is controlled to move along the linear guide rail 22, i.e., move along a radial direction of the polishing pad 81, such that a radial surface profile of the polishing pad 81 is obtained.

When measuring the surface profile of the planar part 88, falling the lifting plate 6, and the mechanical arm 4 feeds the polished planar part 88 to the washing station 53 for washing. The planar part is fed to the drying station 52 for drying after the polishing slurry and rest impurities are removed, and are transferred to the measuring station 51 to measure the surface profile of the planar part 88 after the surface of the planar part 88 is clean.

FIG. 3 is a schematic diagram of a polishing pad surface dressing mechanism 7. The apparatus includes a cylindrical shaft 73, a linear bearing 72 in sliding fit with the cylindrical shaft 73, a motor 71 mounted on a side of the cylindrical shaft 73, and a diamond dresser 74 mounted on a rotating shaft of the motor 71 through a shaft coupler.

When the pad needs to be dressed, the diamond dresser 74 is in contact with the polishing pad 81, and a constant contact pressure is maintained between the diamond dresser 74 and the polishing pad 81 by virtue of the direct sliding fit of the linear bearing 72 and the cylindrical shaft 73, and the motor 71 is started, such that the diamond dresser 74 is driven to rotate to dress the polishing pad 81.

FIG. 4 is a schematic diagram of a continuous polishing pad mechanism 8. The apparatus includes a turntable 89 mounted on a spindle of the continuous polisher by a fixing bolt 82, the polishing pad 81 attached on the turntable 89, a fixing frame 86 mounted on the substrate, a driving wheel motor 85 mounted on a sidewall of the fixing frame 86, a shift fork 84 mounted on the sidewall of the fixing frame 86 and located below the driving wheel motor 85, a driven wheel 87 and a driving wheel 83 respectively mounted on two ends of the shift fork 84 and suspended above the polishing pad 81, and the to-be-polished planar part 88 tightly attached to the driving wheel 83 and the driven wheel 87.

When the planar part 88 needs to be polished, the driving wheel motor 85 is started to rotate the driving wheel 83. The planar part 88 rotates with the driving wheel 83, and a loading block is placed on the planar part 88, such that the planar part 88 keeps a constant pressure contact with the polishing pad 81 during the polishing, thereby implementing quick convergence of the surface profile of the planar part 88.

Figure 5:
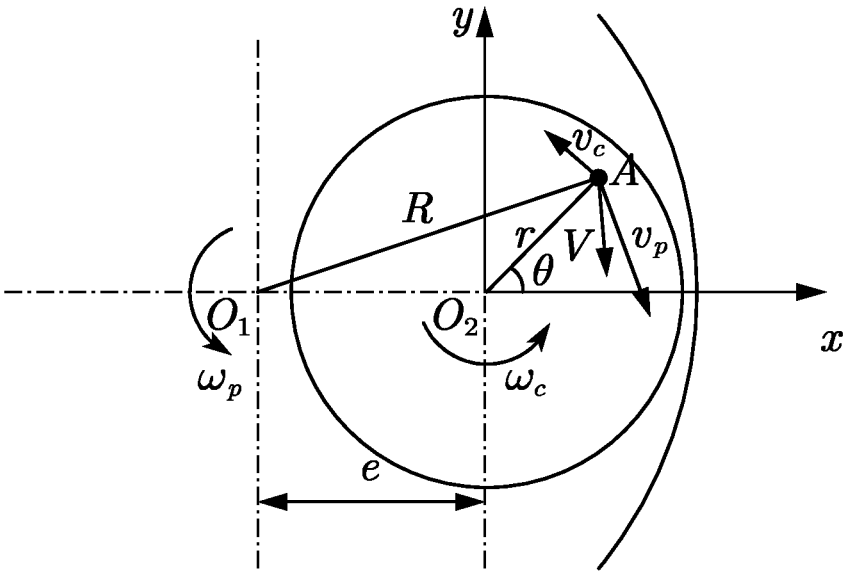
FIG. 5 is a principle diagram of a relative velocity of a planar part relative to a polishing pad.

FIG. 5 is a principle diagram of a relative velocity of a planar part relative to a polishing pad. The equation (5) in step C1 refers to this diagram.

Figure 6:
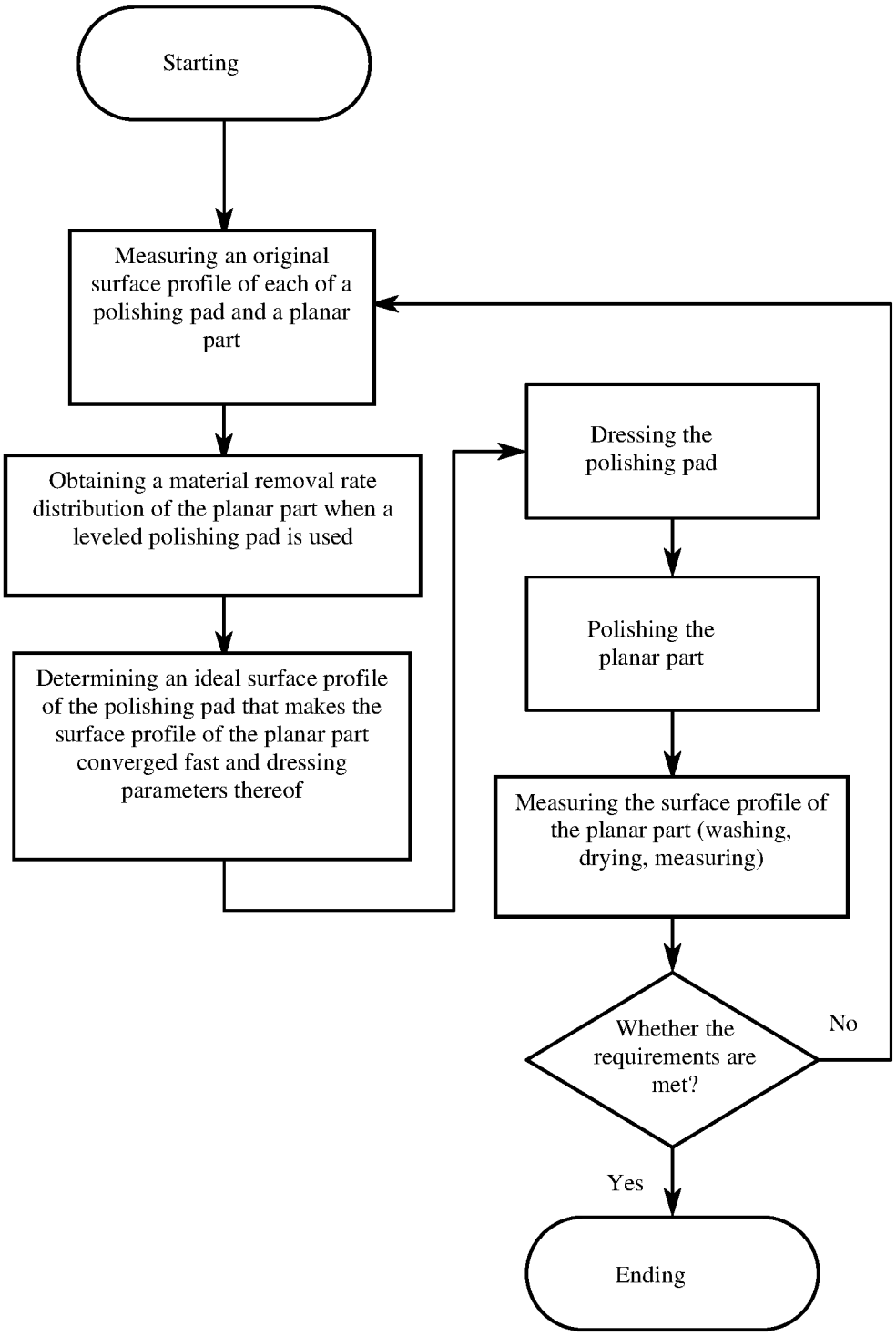
FIG. 6 is a flowchart of full-aperture deterministic polishing.

FIG. 6 is a flowchart of full-aperture deterministic polishing, including the following steps:

In Step 1: an original surface profile of each of the polishing pad 81 and the planar part 88 is measured, the polishing pad 81 is leveled and the planar part 88 is polished. A material removal rate distribution is obtained through a difference between surface profiles before and after polishing the planar part 88. According to the surface profile of each of the planar part 88 and the leveled polishing pad 81 as well as the removal rate distribution of the planar part 88 when polished with the leveled polishing pad 81, an ideal surface profile of the polishing pad and dressing parameters thereof that can make the surface profile of the planar part converged fast are determined by using a polishing pad surface profile design method then the polishing pad 81 is dressed to the ideal surface profile and the planar part 88 is polished.

In Step 2: a measurement is made to determine whether the planar part 88 meets a machining precision requirement; and if yes, the machining is stopped.

In Step 3: step 1 is continuously performed if the planar part does not meet the machining precision requirement.

According to the embodiment of the present invention, the to-be-machined planar part 88 has a diameter of Φ200 mm, and the polishing pad 81 has a diameter of Φ610 mm.

As shown in FIG. 2, the process in the embodiment of the present invention includes:

Step 1: the polishing pad 81 is attached to the turntable 89 with a diameter of Φ610 mm, and the turntable 89 is mounted on the spindle of the continuous polisher.

Step 2: the original surface profile of the polishing pad 81 is collected by the polishing pad surface profile measuring apparatus 2, the dressing time of the diamond dresser 74 at each position is controlled by using the rocker mechanism 3 according to the measurement data of the original surface profile, the polishing pad 81 is leveled and the planar part 88 is polished. A material removal rate distribution is obtained through the difference between surface profiles before and after polishing the planar part 88, and according to the surface profile of each of the planar part 88 and the leveled polishing pad 81 as well as the removal rate distribution of the planar part 88 when polished with the leveled polishing pad 81, an ideal surface profile of the polishing pad 81 and dressing parameters thereof that can make the surface profile of the planar part 88 converged fast are determined by using a polishing pad surface profile design method.

Step 3: the diamond dresser 74 is in contact with the polishing pad 81 and a constant contact pressure is maintained between the diamond dresser 74 and the polishing pad 81 by virtue of direct sliding fit of the linear bearing 72 and the cylindrical shaft 73; a motor 71 is started to rotate the diamond dresser 74; a stepping motor 33 is started, and the dressing time of the diamond dresser 74 at each position is adjusted by controlling a swing speed of the rocker 31; and the polishing pad 81 is dressed to the ideal surface profile.

Step 4: the planar part 88 is polished with the obtained ideal polishing pad 81. Falling the lifting plate 6 upon the completion of the polishing processing, the polished planar part 88 is fed by the mechanical arm 4 to a washing station 53 for washing; and the planar part is fed to a drying station 52 for drying after removing the polishing slurry and rest impurities, and then is transferred to a measuring station 51 to measure the surface profile of the planar part 88 after the surface of the planar part 88 is clean; whether a machining result meets a requirement is determined, and if no, the above entire process is repeated till the surface of the high-precision planar part 88 meeting the requirement is obtained.

The present invention is not limited to the embodiment, and any equivalent concept or alternation within the technical scope disclosed by the present invention is listed into the scope of protection of the present invention.

What is claimed is:

1. A rocker polishing apparatus for full-aperture deterministic polishing of a planar part, comprising: a control system, a substrate (1), a lifting plate (6), a polishing module and a measuring module, wherein the control system is configured to control a pose of a mechanical arm, a swing of a rocker (31), a movement of a guide rail slider, start of a laser displacement sensor (21), a rise and fall of the lifting plate (6), start of a motor (71) connected to a diamond dresser (74) and operation of a continuous polisher; a control panel of the control system is located at a side of the apparatus;

both the polishing module and the measuring module are located on the substrate (1); the lifting plate (6) is located between the polishing module and the measuring module;

the polishing module comprises a rocker mechanism (3), a polishing pad surface dressing mechanism (7), a polishing pad surface profile measuring apparatus (2) and a continuous polishing pad mechanism (8);

the rocker mechanism (3) comprises a stepping motor (33), an upright post (32) and the rocker (31); the upright post (32) is mounted on the substrate (1), a first end of the rocker (31) is hinged to the upright post (32), and a second end of the rocker (31) is suspended above the continuous polishing pad mechanism (8);

the polishing pad surface dressing mechanism (7) comprises a cylindrical shaft (73), a linear bearing (72), the motor (71) and the diamond dresser (74); and the cylindrical shaft (73) is fixed on a rear side of the rocker (31), the motor (71) is mounted on the cylindrical shaft (73) through the linear bearing (72), and the diamond dresser (74) is mounted on a rotating shaft of the motor (71) and located above a polishing pad (81);

the polishing pad surface profile measuring apparatus (2) comprises a linear guide rail (22) and the laser displacement sensor (21); and the linear guide rail (22) is fixed on a front side of the rocker (31), the laser displacement sensor (21) is slidably connected to the linear guide rail (22) through a slider, and the laser displacement sensor (21) is fixed below the slider;

the continuous polishing pad mechanism (8) comprises the polishing pad (81), a fixing bolt (82), a driven wheel (83), a shift fork (84), a driving wheel motor (85), a fixing frame (86), a driving wheel (87) and a turntable (89); and the turntable (89) is mounted on a spindle of the continuous polisher by the fixing bolt (82); the polishing pad (81) is adhered on the turntable (89); the fixing frame (86) is mounted on the substrate (1) by a bolt; the driving wheel motor (85) is mounted on a sidewall of the fixing frame (86); the shift fork (84) is mounted on the sidewall of the fixing frame (86) and located below the driving wheel motor (85); and the driven wheel (83) and the driving wheel (87) are respectively mounted on two ends of the shift fork (84) and suspended above the polishing pad (81);

the measuring module comprises a planar part surface profile automatic measuring apparatus (5) and a mechanical arm (4); the planar part surface profile automatic measuring apparatus (5) comprises a washing station (53), a drying station (52) and a measuring station (51);

the washing station (53), the drying station (52) and the measuring station (51) are sequentially mounted on the substrate (1); and a base of the mechanical arm mechanism (4) is fixed on a sidewall of the whole apparatus and located above the drying station (52);

the stepping motor (33) controls, through the control system, an angle and a speed that the rocker (31) rotates along the upright post (32);

the polishing pad surface profile measuring apparatus (2) is driven by the rocker (31) to a position where a measurement locus of the laser displacement sensor (21) passes through a centre of the polishing pad (81), and a pose of the laser displacement sensor (21) and a height towards the polishing pad (81) are adjustable, and the laser displacement sensor (21) is controlled to move along the linear guide rail (22); and the polishing pad surface dressing mechanism (7) is connected to the rocker (31) by the linear bearing (72); in a process of dressing the polishing pad (81), the diamond dresser (74) is contacted with a surface of the polishing pad (81) at a constant pressure through self-weight and a weight of the motor (71), and dressing times of the diamond dresser (74) at different radial positions of the polishing pad (81) is controlled by controlling a swing speed of the rocker (31), thereby implementing deterministic dressing of the polishing pad (81).

2. The rocker polishing apparatus for the full-aperture deterministic polishing of the planar part according to claim 1, wherein the washing station (53) comprises a deionized water spraying device and a sewage storage container; the drying station (52) comprises a rack having a planar part (88) clamping device and a strong blower; and the measuring station (51) comprises a planeness measurer.

3. A rocker polishing method for full-aperture deterministic polishing of a planar part, using a rocker polishing apparatus for the full-aperture deterministic polishing of the planar part, comprises the following steps:

step A. measuring original surface profiles of a polishing pad (81) and a planar part (88)

adjusting a rocker (31) to a position where a measuring head of a laser displacement sensor (21) moves radially along the polishing pad (81), collecting an original surface profile of the polishing pad (81) by moving a laser displacement sensor (21) along a linear guide rail (22); and feeding the planar part (88) to a measuring station (51) with the mechanical arm (4) to obtain an original surface profile of the planar part (88);

step B. obtaining a material removal rate distribution of the planar part when a leveled polishing pad is used starting the linear guide rail and the laser displacement sensor (21) such that a slider of the linear guide rail drives the laser displacement sensor (21) to move radially along the polishing pad (81), thereby measuring the original surface profile of the polishing pad (81); starting the rocker and a motor (71) connected to a diamond dresser (74) such that the diamond dresser (74) dresses the polishing pad (81) at a constant speed along a radial direction of the polishing pad (81), thereby remeasuring a surface profile data of the polishing pad (81); and according to a difference between surface profiles before and after the polishing pad (81) is dressed and a dressing time, obtaining a dressing removal rate distribution of the polishing pad (81) as follows:

$$MRR_{pi} = \frac{u_{pi}^{0} - u_{pi}^{1}}{t_p} n,\ i = 1, 2, 3 \ldots n \tag{1}$$

wherein, the $MRR_{pi}$ represents a dressing removal rate of the polishing pad (81) at the $i^{th}$ discrete point, the $u_{pi}^{0}$ represents an original surface profile of the polishing pad (81) at the $i^{th}$ discrete point, the $u_{pi}^{1}$ represents a dressed surface profile of the polishing pad (81) at the $i^{th}$ discrete point, the $t_p$ represents dressing time of the polishing pad (81), and n represents the number of radial discrete points of the polishing pad (81); the surface profile is the height data of all discrete points on the surface of the polishing pad (81);

differencing the original surface profile of the polishing pad (81) with a horizontal plane to determine a removal amount distribution of the surface of the polishing pad (81); keeping a dressing pressure constant in a dressing process, the dressing removal rate distribution of the polishing pad being known, and determining the dressing time of the diamond dresser (74) at each radial position of the polishing pad (81), polishing the planar part (88) on the leveled polishing pad (81) after dressing, and obtaining the material removal rate distribution $MRR_c$ (r,θ) of the planar part through a difference between surface profiles before and after the planar part (88) is polished:

$$MRR_c(r, \theta) = \frac{u_c(r, \theta) - u_c'(r, \theta)}{t_c} \tag{2}$$

wherein, the $MRR_c$ (r,θ) represents the material removal rate distribution of the planar part, the $u_c$(r,θ) represents a surface profile of the planar part (88) before polishing, the $u_c'$(r,θ) represents a surface profile of the planar part (88) after polishing, the r represents a distance from a point on the planar part (88) to a center of the planar part (88), the θ represents an angle of a point on the planar part (88) in a coordinate system with the center of the planar part (88) as an origin, and the $t_c$ represents a polishing time;

step C. determining an ideal surface profile of the polishing pad (81) that makes the surface profile of the planar part (88) converged fast and dressing parameters thereof determining, according to the surface profile of each of the planar part (88) and the leveled polishing pad as well as the removal rate distribution of the planar part (88) when it is polished by the leveled polishing pad, by using a polishing pad surface profile design method, the ideal surface profile of the polishing pad that makes the surface profile of the planar part (88) converged fast and the dressing parameters thereof, comprising the following steps:

step C1. obtaining a Preston coefficient K(r,θ): the material removal rate distribution of the planar part meeting a Preston equation:

$$MRR_c(r,\theta)=K(r,\theta)P(r,\theta)V(r,\theta) \tag{3}$$

wherein, the K(r,θ) represents the Preston coefficient, the P(r,θ) represents a contact pressure during polishing processing, and the V(r,θ) represents a rotational velocity of the planar part (88) relative to the polishing pad (81);

converting the Preston equation (3) into equation (4) to obtain the Preston coefficient K(r,θ):

$$K(r, \theta) = \frac{MRR_c(r, \theta)}{P(r, \theta)V(r, \theta)} \tag{4}$$

calculating the material removal rate distribution $MRR_c$ (r,θ) of the planar part (88) according to equation (2) when polished with the polishing pad (81);

obtaining, according to a rotational velocity parameter used in the polishing process, relative velocity V(r,θ) of the planar part (88) and the polishing pad (81) at each position by kinematics analysis as follows:

$$\begin{cases} V(r, \theta) = \sqrt{\upsilon_x(r, \theta)^2 + \upsilon_z(r, \theta)^2} \\ \upsilon_x(r, \theta) = -\omega_c r\sin\theta + \omega_p r\sin\theta \\ \upsilon_y(r, \theta) = \omega_c r\cos\theta - \omega_p(e + r\cos\theta) \end{cases} \tag{5}$$

wherein, the $v_z$ (r,θ) represents velocity components of relative velocity of the planar part (88) and the polishing pad (81) on an x axis of the planar part (88), the $v_y$(r,θ) represents velocity components of relative velocity of the planar part (88) and the polishing pad (81) on a y axis of the planar part (88), the $\omega_p$ represents a revolution velocity of the polishing pad (81), and the $\omega_c$ represents a rotation velocity of the planar part (88);

calculating a contact pressure distribution model based on a Winkler elastic foundation model:

$$P(r, \theta) = \begin{cases} K[\delta - u(r, \theta)], & \delta > u(r, \theta) \\ 0, & \delta \leq u(r, \theta) \end{cases} \tag{6}$$

$$K = \frac{(1 - v)E}{(1 + v)(1 - 2v)L}$$

$$u(r, \theta) = u_c(r, \theta) - u_p(r, \theta)$$

$$\frac{F}{K} = \sum A[\delta - u(r, \theta)]$$

wherein, the K represents a stiffness coefficient, the δ represents contact deformation, the $u$ (r,θ) represents a thickness of an elastic layer, the v represents a Poisson ratio, the E represents an elasticity modulus, the L represents a thickness of the polishing pad (81), the $u_p$ (r,θ) represents a circumferentially homogenized surface profile of the polishing pad (81) within a range of the polishing processing, the F represents a positive pressure, and the A represents an area of a region represented by a discrete point of the planar part (88);

obtaining, based on the Winkler elastic foundation model, a polishing pressure P(r,θ) of each point by mechanical analysis in a condition where the surface profile of the planar part (88) and the surface profile of the leveled polishing pad are known; and therefore, obtaining the Preston coefficient K(r,θ) of the planar part (88) according to the equation (4) due to the $MRR_c(r,\theta)$, the V(r,θ) and the P(r,θ) are obtained;

step C2. obtaining the ideal surface profile of the polishing pad based on a hypothesis that the Preston coefficient in the polishing process is unchanged and the Winkler elastic foundation model, performing normalization and mirror symmetry treatment on the surface profile of the planar part (88) obtained in step B, which is taken as a normalization result of the material removal rate distribution $MRR_c'(r,\theta)$ of the planar part corresponding to an ideal polishing pad, and making an analysis in combination with a model for calculating the material removal rate distribution of the planar part to obtain the ideal surface profile of the polishing pad required by the full-aperture deterministic polishing;

a method for obtaining the ideal surface profile of the polishing pad comprising:

performing the normalization and mirror symmetry treatment on the surface profile of the planar part (88) obtained in step B, which is taken as the normalization result of the material removal rate distribution $MRR_c'(r,\theta)$ of the planar part corresponding to the ideal polishing pad, with a equation as follows:

$$\frac{MRR_c'(r,\theta)-\min[MRR_c'(r,\theta)]}{\max[MRR_c'(r,\theta)]}=\frac{-u_c'(r,\theta)-\min[-u_c'(r,\theta)]}{\max[-u_c'(r,\theta)]} \quad (7)$$

$$\frac{MRR_c'(r,\theta)-\min[MRR_c'(r,\theta)]}{\max[MRR_c'(r,\theta)]}=\frac{u_c'(r,\theta)-\max[u_c'(r,\theta)]}{\min[u_c'(r,\theta)]}$$

based on the hypothesis that the Preston coefficient K(r,θ) in the polishing process is unchanged, in view of an actual condition where the V(r,θ) is unchanged due to the rotational velocity process parameter used in the polishing process is unchanged, making the analysis in combination with the model for calculating the material removal rate distribution of the planar part to obtain a normalization result of an ideal contact pressure distribution P'(r,θ) on the surface of the planar part; and based on the Winkler elastic foundation model, in a condition where the surface profile of the planar part (88) obtained in step B is known, obtaining a contact pressure corresponding to any surface profile of the polishing pad (81), taking the normalization result of the ideal contact pressure distribution P'(r,θ) as an optimization goal to obtain the corresponding ideal surface profile of the polishing pad required by the full-aperture deterministic polishing, and obtaining the ideal contact pressure distribution P'(r,θ) on the surface of the planar part (88);

step C3. determining the dressing parameters of the polishing pad (81)

determining, as the ideal surface profile of the polishing pad and the surface profile of the leveled polishing pad are respectively measured, keeping the dressing pressure constant in the dressing process, and the dressing removal rate distribution of the polishing pad is known according to step B, a dressing time of the diamond dresser (74) at the radial position of the polishing pad (81) as follows:

$$T_{pi}=\frac{u_{pi}-u_{pi}'}{MMR_{pi}},\ i=1,2,3\ldots n \quad (8)$$

wherein, the $T_{pi}$ represents dressing time of the diamond dresser (74) at the $i^{th}$ discrete point of the polishing pad (81), the $u_{pi}$ represents a surface profile of the leveled polishing pad at the $i^{th}$ discrete point, and the $u_{pi}'$ represents an ideal surface profile of the polishing pad (81) at the $i^{th}$ discrete point; and step C4. predicting the polishing time obtaining the material removal rate distribution $MRR_c'(r,\theta)$ of the planar part corresponding to the ideal polishing pad as follows:

$$MRR_{pi}=\frac{u_{pi}^0-u_{pi}^1}{t_p}n,\ i=1,2,3\ldots n \quad (1)$$

deducing an evolution of the surface profile of the planar part (88) in the polishing process in combination with the surface profile of the planar part (88) and the material removal rate distribution $MRR_c'(r,\theta)$ of the planar part corresponding to the ideal polishing pad obtained in step B, and selecting a maximum peak valley (PV) value of the surface profile of the planar part (88), i.e., corresponding polishing time when the PV value is minimum, as the predicted polishing time;

step D. dressing the polishing pad (81)

controlling a polishing pad surface dressing mechanism (7) to dress the surface profile of the polishing pad (81) as the calculated ideal surface profile of the polishing pad;

step E. polishing the planar part (88)

polishing the planar part (88) with the parameters same as those when the material removal rate distribution of the planar part is obtained with the leveled polishing pad in step B, the parameters comprising a rotation velocity of each of the planar part (88) and the polishing pad (81), a component of a polishing slurry, a supply position of the polishing slurry, a flow velocity of the polishing slurry and a polishing load; and step F. measuring the surface profile of the planar part (88)

feeding, by the mechanical arm (4), the polished planar part (88) to a washing station (53), and washing to remove the polishing slurry and rest impurities on the surface of the planar part (88) with deionized water at 20-26° C.; then feeding the planar part (88) to a drying station (52) to clamp, and quickly drying the planar part (88) with a strong blower that outputs room temperature air at 20-26° C.; and after the surface of the planar part (88) is clean, transferring the planar part to the measuring station (51) to measure the surface profile of the planar part (88), determining whether a polishing result meets a requirement; and if no, performing step A till a surface of a high-precision planar part (88) meeting the requirement is obtained.

* * * * *